United States Patent [19]

Young, Sr.

[11] 4,017,914

[45] Apr. 19, 1977

[54] WATER CLOSET METERING DEVICE

[76] Inventor: Daniel J. Young, Sr., 3137 Capri Road, Lake Park, Fla. 33410

[22] Filed: June 18, 1976

[21] Appl. No.: 697,359

Related U.S. Application Data

[63] Continuation-in-part of Ser. No. 629,144, Nov. 5, 1975.

[52] U.S. Cl. ..... 4/67 A; 4/34

[51] Int. Cl.[2] ..... E03D 1/34; E03D 5/02; A61B 19/00

[58] Field of Search ..... 4/1, 67 R, 67 A, 57 R, 4/57 P, 56, 18, 26, 34, 37, 32, 39, 40, 41, 35

[56] References Cited

UNITED STATES PATENTS

| | | | |
|---|---|---|---|
| 2,440,389 | 4/1948 | Anderson, Sr. | 4/57 R |
| 2,526,294 | 10/1950 | Stageman | 4/67 A |
| 2,645,780 | 7/1953 | Becker | 4/67 A |
| 2,744,261 | 5/1956 | Gram | 4/67 A |
| 2,950,483 | 8/1960 | Richards | 4/67 A |
| 3,156,930 | 11/1964 | Moulton et al. | 4/67 A |
| 3,259,918 | 7/1966 | Walker, Sr. et al. | 4/18 |
| 3,775,778 | 4/1973 | Lee | 4/67 A |
| 3,877,081 | 4/1975 | Klein | 4/1 |
| 3,885,253 | 5/1975 | Overbey | 4/67 A |

*Primary Examiner*—Henry K. Artis

[57] ABSTRACT

A metering device for use in a conventional flush toilet having a flush tank for regulating the amount of water utilized in filling the flush bowl and trap of the toilet. The device includes a metering tank disposed in the flush tank which is filled with a fixed volume of water, a first conduit from the flush tank inlet water supply into said metering tank, a second conduit disposed between the metering tank and the overflow tube which is utilized to refill the bowl and trap, and a valve means disposed in said second conduit for regulating the flow of water from the metering tank into the overflow tube. Applicant has determined that the conventional toilet having a flush tank utilizes an excess amount of water which is lost during the flushing action in refilling the flush bowl and trap. The metering tank and valve delays the filling of the flush bowl and trap until after the flushing action is completed and regulates the total amount of water receivable into the trap and bowl. The device is also useful with partial flush systems to insure that the trap and bowl are adequately filled.

2 Claims, 3 Drawing Figures

WATER CLOSET METERING DEVICE

This invention is a continuation-in-part of application Ser. No. 629,144; filed Nov. 5, 1975.

BACKGROUND OF THE INVENTION

This invention relates generally to a metering device for use with a conventional water closet which reduces water waste without adversely affecting the operational efficiency of a conventional water closet. The invention can be easily and quickly installed in a conventional flush tank found in present day water closets, or may be utilized with a partial flush system which uses less tank water during certain operations.

In the operation of a conventional flush tank having full flush operation, it has been determined that one to two gallons of water are wasted in filling the trap and bowl, since the bowl and trap are being filled while the toilet is flushing. The trap and bowl in a conventional flush system receive an excessive amount of water, above that amount necessary for operation. The prior art has not shown a device which reduces excess water flowing in to refill the trap and bowl during and after the full flush tank refill operation commenced.

Conversely many prior art partial or dual mode flush systems are shown. A problem with some of these devices is that they do not adequately fill the trap and bowl. With the instant invention the proper amount of water can be metered into the trap and bowl during full or partial flush tank operation.

The instant invention provides a non-complex, readily installable metering device which is adapted to be mounted in a conventional flush tank which adjustably regulates the amount of water that is received into the flush bowl and trap after the flush tank has been actuated.

BRIEF DESCRIPTION OF THE INVENTION

A flush toilet bowl and trap water fill metering device including a bowl-trap fill metering tank positioned within a conventional flush tank and a first metering tank inlet water source conduit connected to the flush tank inlet valve outlet (conventionally heretofore disposed in the overflow tube) for filling the bowl and trap. A second conduit, used to siphon water from the meter tank into the overflow tube, is connected between the meter tank which is affixed to the side of the flush tank and the overflow tube and includes an adjustable valve to regulate the flow of water between the meter tank and the overflow tube. The meter tank is filled to capacity by the first conduit while the flush tank is being filled. The second conduit extended between the meter tank and the overflow tube, which has its outlet in fluid communication with the bowl and trap, acts to siphon water from the meter tank into the trap and bowl through the overflow tube.

The meter tank regulating valve includes a siphon control tube which has an open end positioned to be immersed below the top level of the water in the flush tank, when filled. In order for the meter tank to siphon its water into the overflow tube (to fill the trap and bowl) two conditions must be present. The first condition is that the meter tank itself must be filled such that the level of water in the meter tank is disposed above the uppermost portion of the second conduit used to siphon the water from the tank to the overflow tube. The second condition is that the metering valve siphon control tube must itself be immersed in water from the flush tank or no siphon action will be possible. Thus, while the flush tank is filling (until the level of the flush tank water reaches the open end of the siphon control tube in the metering valve) no water is being recieved into the overflow tube to fill the trap and bowl. This allows the toilet bowl and trap to be thoroughly flushed prior to the refilling operation to prevent premature filling which would result in excess water being utilized during the flusing operation which would not be employed to actually refill the bowl and trap. The siphon control tube on the meter tank regulating valve is disposed of a particular length such that while the flush tank is filling during its last few inches the siphon action is allowed to commence which empties the metering tank. Thus the filling of the flush bowl and trap are completely independent of the amount of time that the inlet flush tank water valve is on. Additional water received into the metering tank when filled merely spills back into the flush tank while the flush tank is filling. The regulating valve includes an adjustable valve stem which is threadedly attached to the valve chamber which allows the siphon rate of flow to be adjusted if, depending on a particular flush toilet system, it is necessary to provide additional water into the bowl and trap than is provided in the metering tank. The siphon control tube connected to the metering valve chamber can be adjusted to siphon additional water from the upper level of the flush tank water into the overflow tube, while the metering tank itself is being emptied. Once the metering tank is empty, the siphon is broken stopping any siphoning action from the siphon control tube. This would provide additional water to the bowl and trap dependent upon the regulating valve system setting in the valve chamber. In the full open position of the valve the siphon action from the metering tank into the overflow tube will be rather fast such that the resultant water in the bowl and trap will be approximately the volume of the metering tank itself. With the metering jet partially closed, the siphon flow from the meter tank to the overflow tube is restricted to delay the siphon time which allows additional time for water to siphon from the flush tank into the overflow tube if necessary. With a partial flush tank system, flush tank refill time is shortened, reducing trap and bowl fill. With the present invention, adequate trap and bowl filling is insured by additional flow into the overflow tube by the siphon action from the siphon control tube from the upper level of water in the flush tank.

The maximum amount of water which can be utilized to fill the bowl and trap is determined by the volume of the meter tank and the valve setting of the metering valve.

It is an object of this invention to provide a flush tank actuating mechanism which includes a bowl and trap fill metering tank for eliminating excessive water use in the refilling of the bowl and bowl trap in a conventional flush toilet.

It is another object of this invention to provide a metering tank within a conventional flush tank having partial full capability which has an adjustable valve to regulate the amount of water used to refill a conventional flush bowl and trap.

In accordance with these and other objects which will be apparent hereinafter, the instant invention will now be described with particular reference to the accompanying drawings.

PREFERRED EMBODIMENT OF THE INVENTION

Figure 1:
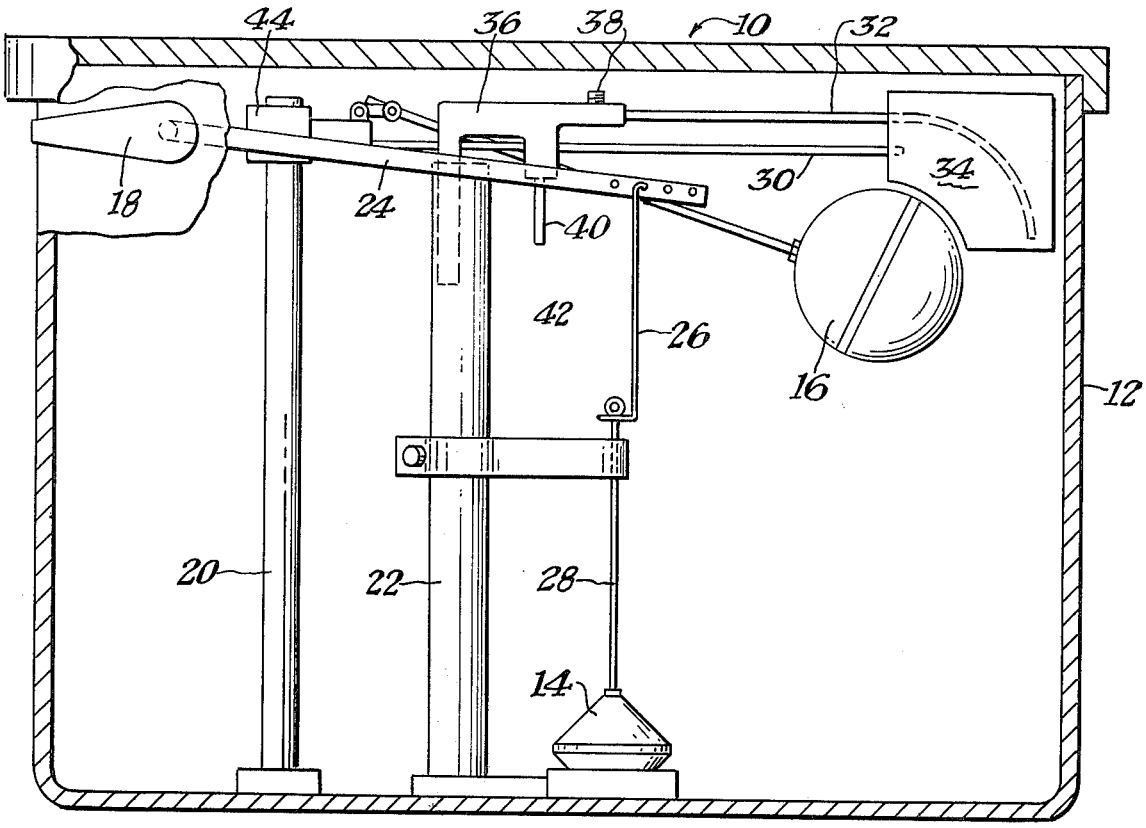
FIG. 1 shows a flush tank in a front elevational view, partially in cross-section with the instant invention mounted therein.

Referring now to the drawings and specifically to FIG. 1, a conventional water closet flush tank toilet is shown which includes an actuating handle 18 connected to rod 24 and linkage rod 28. Briefly, the flush tank is emptied when the flush ball is raised. The float 16 controls the inlet water valve to refill the tank. This mechanism is conventional and is found in many flush tanks today. The instant invention, shown generally at 10, includes a metering tank 34 connected to one inside wall of the flush tank, the metering tank being in fluid communication with the flush tank inlet water valve 44 via conduit 30. In a conventional flush tank heretofore, the inlet valve 44 would have a conduit disposed into the overflow tube 22 which provided water into the overflow tube 22 while the flush tank was refilling in order to refill the flush bowl and trap. With the instant invention, the inlet valve conduit 30 has its outlet in the metering tank 34 which is filled to capacity while the flush tank fills.

Also connected to the meter tank 34 is a second conduit 32 which has one end connected within the bottom of the meter tank 34 and the opposite end connected to a regulating valve 36. Conduit 32 provides for the siphoning of water from metering tank 34 to the overflow tube 22. The regulating valve 36 has an outlet conduit 42 which is disposed in the overflow tube 22. The valve 36 includes a siphon control tube 40 and a flow metering jet 38. The operation of the valve 36 is described in greater detail below.

Figure 2:
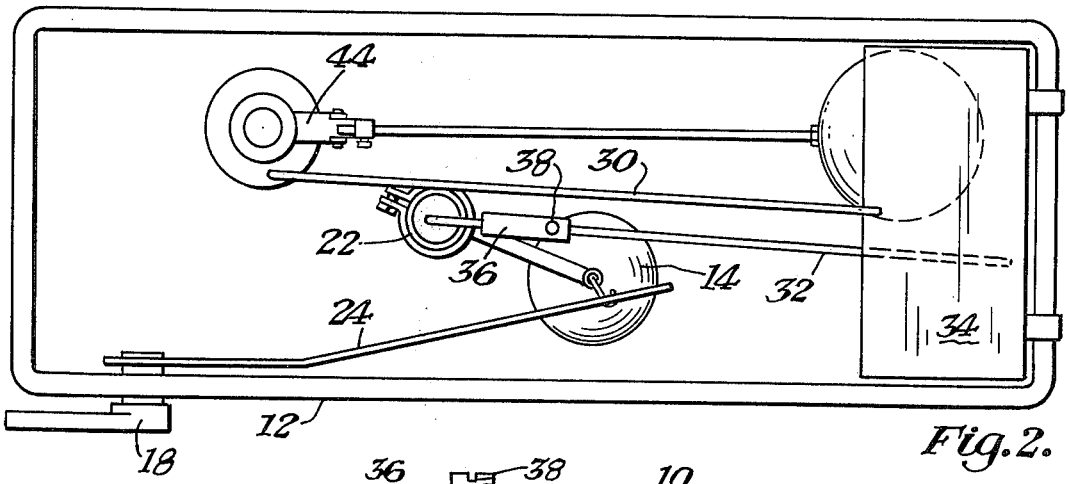
FIG. 2 is a top plan view of the flush tank with the top cover removed showing the instant invention.

FIG. 2 shows the metering tank 34 is connected to one side of the flush tank 12 and conduit 30 coming from the inlet water valve housing 44 into the metering tank with the outlet conduit 32 in fluid communication between the meter tank 34 and the inside of overflow tube 22. Valve 36 is disposed along conduit 32 between the metering tank 34 and the overflow tube 22. The valve includes a metering jet 38 which is threadedly attached into the valve chamber to regulate the flow of fluid into the overflow tube 22 received from the metering tank 34.

Figure 3:
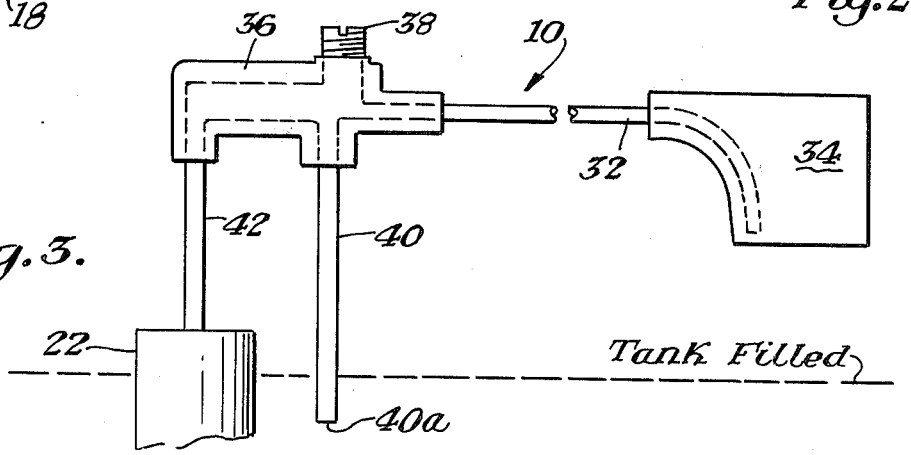
FIG. 3 shows a side elevational view of the instant invention partially cut away.

FIG. 3 shows the metering tank 34 and the siphon conduit 32 connected to valve 36 and the regulating jet 38 disposed therein. The valve 36 has one outlet tube 42 and siphon control tube 40. Outlet conduit 42 is disposed within the overflow tube 22, while control tube open end **40*a* is disposed about 1 inch below the filled water level of the flush tank 12.**

In the operation of the device, when ever the toilet is flushed, the flush tank 12 empties as the flush ball 14 is pulled away from the outlet into the flush bowl. Once the float 16 drops, the inlet water valve 44 into the flush tank is actuated, which, in a conventional flush tank, would cause water to flow into the overflow tube. With the instant invention, once the float 16 drops, inlet flow from the inlet valve 44 causes flow in conduit 30 which acts to fill the meter tank 34. In order for the flush bowl and trap to fill, a siphon action will begin in conduit 32 which siphons water from the meter tank 34 into the overflow tube to fill the trap and the bowl whenever the water level in tank 34 is above conduit 32 and tube end **40*a* is immersed in flush tank water. The amount of water siphoned into tube 42 will be the amount received into the flush bowl and trap. The metering jet 38 adjustable in the valve chamber controls the amount of flow and the flow rate from the meter tank 34 into the overflow tube 22. When jet 38 is up (full open) tank 34 empties quickly, not allowing a siphon through tube 40 which is smaller in diameter than conduit 32. As the metering jet 38 is positioned into the valve chamber, siphon flow in conduit 32 is restricted which allows at some point siphoning in tube 40 from the flush tank into overflow tube 22 to increase the amount of water in the trap and bowl if necessary. Once the meter tank 34** is empty, all siphon action is broken.

The meter tank 34 and valve 36 cooperate to regulate the specific quantity of water received into the bowl and trap during each flushing of the flush tank. The meter tank 34 could in an alternate embodiment be emptied by gravity flow in lieu of siphoning.

The meter tank may be placed anywhere within the flush tank that is convenient and does not interfer with the actuating and linkage mechanism for actuating the flush bowl. When employed with a partial flush system, adequate bowl and trap water is provided.

The instant invention has been shown and described in what is considered to be the most practical and preferred embodiment. It is recognized, however, that departures may be made therefrom within the scope of the invention and that obvious modifications will occur to a person skilled in the art.

What I claim is:

1. A water closet having a flush tank, a water inlet valve, and overflow pipe is coupled into the toilet bowl, a flush bowl and a flush bowl actuating mechanism, said flush tank including:

a trap fill meter tank disposed within said flush tank;

a conduit from said inlet water valve connected into said meter tank;

a siphon tube disposed with one end in said reserve tank and the opposite end disposed in said overflow pipe, said siphon tube being positioned below the uppermost level of the water in the meter tank when filled and said receptacle having an open top whereby during the flushing operation of the flush tank, the inlet water valve will fill the meter tank and the siphon conduit will empty the meter tank into the overflow pipe and toilet trap; and an adjustable valve connected to said siphon tube between said fill meter tank and said overflow pipe for adjusting the rate of flow from the meter tank into the overflow pipe.

2. The device as in claim 1, including:

siphon control means connected to said valve and disposed in said flush tank to regulate the siphon action in said siphon tank tube as a function of flush tank water level.

* * * * *